US008049398B2

(12) United States Patent
Kitahara et al.

(10) Patent No.: US 8,049,398 B2
(45) Date of Patent: Nov. 1, 2011

(54) HIGH-PRESSURE DISCHARGE LAMP, LAMP UNIT USING THE SAME, AND PROJECTIVE IMAGE DISPLAY DEVICE USING THE LAMP UNIT

(75) Inventors: Yoshiki Kitahara, Osaka (JP); Katsuhiro Ono, Osaka (JP); Jun Sakaguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 140 days.

(21) Appl. No.: 12/529,009

(22) PCT Filed: Sep. 16, 2008

(86) PCT No.: PCT/JP2008/002544

§ 371 (c)(1), (2), (4) Date: Aug. 27, 2009

(87) PCT Pub. No.: WO2009/069245

PCT Pub. Date: Jun. 4, 2009

(65) Prior Publication Data

US 2010/0013369 A1 Jan. 21, 2010

(30) Foreign Application Priority Data

Nov. 26, 2007 (JP) ..... 2007-304077
Feb. 29, 2008 (JP) ..... 2008-050714

(51) Int. Cl.
*H01J 17/18* (2006.01)
*H01J 19/60* (2006.01)

(52) U.S. Cl. ..... 313/113; 313/318.01; 313/318.12; 313/623; 313/627

(58) Field of Classification Search ..... 313/617–627, 313/25, 26.3, 318.01–318.12, 113
See application file for complete search history.

(56) References Cited

U.S. PATENT DOCUMENTS

| | | | | |
|---|---|---|---|---|
| 5,200,669 | A * | 4/1993 | Dixon et al. | 313/623 |
| 5,527,199 | A * | 6/1996 | Feder et al. | 445/49 |
| 6,426,592 | B2 | 7/2002 | Nishida et al. | |
| 6,597,114 | B1 * | 7/2003 | Tagawa et al. | 313/623 |
| 6,600,266 | B1 | 7/2003 | Nakagawa | |
| 6,693,379 | B2 | 2/2004 | Nishida | |
| 6,875,072 | B2 | 4/2005 | Nishida | |
| 6,903,509 | B2 | 6/2005 | Kanzaki | |
| 2004/0097163 | A1 * | 5/2004 | Nishida | 445/26 |
| 2007/0236669 | A1 * | 10/2007 | Hirata et al. | 353/57 |

FOREIGN PATENT DOCUMENTS

| | | |
|---|---|---|
| JP | 01-15149 | 6/1989 |
| JP | 2001-23570 | 1/2001 |

(Continued)

*Primary Examiner* — Anne Hines
*Assistant Examiner* — Tracie Green

(57) ABSTRACT

A long-life high-pressure discharge lamp can (i) suppress damage to sealing portions, especially at an initial stage of the accumulated lighting time, (ii) allow for easy assembly of components such as electrodes and (iii) prevent deformation/ripping of metallic foils. An arc tube is a glass enveloping vessel with electrodes arranged therein, and includes: a light emitting portion in which materials are enclosed and a discharge space is formed; and sealing portions provided at ends of the light emitting portion. Each electrode includes an electrode bar whose first end is in the discharge space, and whose second end is in the corresponding sealing portion and connected to a metallic foil. The second end of each electrode bar is partially wrapped around by a sleeve-like metallic cover foil that has a cut-out section positioned over a joining area where the second end of each electrode bar is joined to the metallic foil.

10 Claims, 10 Drawing Sheets

FOREIGN PATENT DOCUMENTS

| | | |
|---|---|---|
| JP | 2001-189149 | 7/2001 |
| JP | 2003-187747 | 7/2003 |
| JP | 2003-257373 | 9/2003 |
| JP | 3136588 | 10/2007 |

* cited by examiner

FIG. 7

| | Probability of damage [(number of damaged specimens/total number of specimens)] | |
|---|---|---|
| | Accumulated lighting time ≤ 100 hours | Accumulated lighting time ≤ 2,000 hours |
| Embodiment specimens 1 | 0/100 | 0/100 |
| Comparative specimens 1 | 3/100 | 3/100 |

(a)

PRIOR ART

HIGH-PRESSURE DISCHARGE LAMP, LAMP UNIT USING THE SAME, AND PROJECTIVE IMAGE DISPLAY DEVICE USING THE LAMP UNIT

TECHNICAL FIELD

The present invention relates to a high-pressure discharge lamp, a lamp unit using the high-pressure discharge lamp, and a projection type image display apparatus using the lamp unit.

BACKGROUND ART

A short-arc high-pressure mercury lamp is widely used as a light source for a projection type image display apparatus (e.g., a liquid crystal projector). Such a short-arc high-pressure mercury lamp is a high-luminance light source that is close to a point light source and has a high color rendering index.

FIG. 13A is a cross-sectional front view showing the structure of an arc tube 141 constituting a conventional short-arc high-pressure mercury lamp. An enveloping vessel 141*a* of the arc tube 141 is made of fused quartz. The arc tube 141 includes a light emitting portion 142 and sealing portions 143 and 144. The light emitting portion 142 is in the center of the arc tube 141 and substantially spheroidal in shape. Each of the sealing portions 143 and 144 is substantially cylindrical in shape and connected to the light emitting portion 142 in such a manner that the sealing portions 143 and 144 extend from sides of the light emitting portion 142 outward in opposite directions.

Mercury (not illustrated) and the like are enclosed in the light emitting portion 142 as enclosed materials. Here, the mercury functions as light emitting material. The light emitting portion 142 further encloses portions of a pair of electrodes 145 and 146 made of tungsten, in such a manner that a first end of the electrode 145 and a first end of the electrode 146 are in opposition to each other. A discharge space 147 is also formed in the light emitting portion 142.

The electrodes 145 and 146 have electrode bars 145*a* and 146*a*, respectively. A cross section of each of the electrode bars 145*a* and 146*a* has a circular shape. Second ends of the electrode bars 145*a* and 146*a* are respectively joined, by welding, to strips of rectangular metallic foils 148 and 149 made of molybdenum.

Portions of the electrode bars 145*a* and 146*a*, including the second ends thereof, are embedded in and sealed in the sealing portions 143 and 144, respectively. Here, however, said portions of the electrode bars 145*a* and 146*a* being embedded in the sealing portions 143 and 144 does not mean that the entire circumferential surfaces of said portions of the electrode bars 145*a* and 146*a* are in contact with fused quartz in the sealing portions 143 and 144.

More specifically, some areas of the circumferential surfaces of the electrode bars 145*a* and 146*a* are in contact with the fused quartz; other areas inevitably do not come in contact with the fused quartz. In other words, small clearances exist around said other areas, and the enclosed materials in the light emitting portion 142 may enter said small clearances. In particular, as depicted in FIG. 13B which is an enlarged cross-sectional view of major components of the arc tube 141, a clearance X that is slightly larger than said small clearances is formed in an area where the electrode bar 145*a* (146*a*) lies on the surface of the metallic foil 148 (149).

In view of the above problem, thin metallic foils 148 and 149 having a thickness of 20 [μm] have generally been incorporate in the sealing portions 143 and 144, so as to leave no such clearances during the sealing process and to keep the sealing portions 143 and 144 airtight. Use of these thin metallic foils 148 and 149 alleviates the stress caused by the difference between (i) the coefficient of thermal expansion of the thin metallic foils 148 and 149 and (ii) the coefficient of thermal expansion of the fused quartz. This prevents small cracks from forming around the thin metallic foils 148 and 149.

In contrast, it is not possible, during the sealing process, to alleviate the stress caused by the difference between (i) the coefficient of thermal expansion of the electrode bars 145*a* and 146*a* and (ii) the coefficient of thermal expansion of the fused quartz. Therefore, small cracks form around the electrode bars 145*a* and 146*a*, as well as around joining areas where the electrode bars 145*a* and 146*a* are joined to the metallic foils 148 and 149.

In the above case, the only disadvantage is formation of small cracks. However, some high-pressure mercury lamps enclose a larger amount of mercury (e.g., 0.15 mg/mm$^3$ or more) so as to increase vapor pressure during illumination and achieve higher luminance. With such high-pressure mercury lamps, there have been cases where small cracks, which originally formed on a minuscule scale, grew in size under the stress caused by a high vapor pressure during illumination; this would eventually lead to damage to the sealing portions 143 and 144.

One conventional method to suppress such damage to the sealing portions 143 and 144 (more specifically, to reduce the clearance X in size or remove the clearance X) is to (i) reduce the width of a first end of a metallic foil to which a second end of the electrode bar is to be joined, (ii) wrap the first end of the metallic foil around a portion of the circumferential surface of the electrode bar, and (iii) join the second end of the electrode bar to the first end of the metallic foil by welding (for example, see Patent Document 1).

Another conventional method to suppress such damage is to attach a cylindrical member made of metal, or a metallic coil, to a second end of the electrode bar that is to be joined to a metallic foil in the sealing portion, so that the cylindrical member or the metallic coil functions as a cushion between the electrode bar and the fused quartz. Use of this method alleviates the stress caused by the stated difference between the coefficients of thermal expansion (for example, see Patent Documents 2 and 3). Here, the width of the first end of the metallic foil to which the second end of the electrode bar is to be joined has been reduced. The cylindrical member or the metallic coil covers the first end of the metallic foil, together with the end of the electrode bar which is joined to the first end of the metallic foil.

Patent Document 1:
Japanese Patent Application Publication No. 2003-257373
Patent Document 2:
Japanese Patent Application Publication No. 2001-189149
Patent Document 3:
Japanese Patent Application Publication No. 2003-187747

DISCLOSURE OF THE INVENTION

The Problems the Invention is Going to Solve

It has been confirmed that use of the former method helps suppress damage to the sealing portions 143 and 144. However, with use of this method, although stochastically low in number, a few out of a hundred lamps had their sealing portions 143 and 144 damaged at an initial stage of the accumulated lighting time (e.g., during the aging period in the manufacturing process).

Likewise, it has been confirmed that use of the latter method (i.e., application of the cylindrical member or the metallic coil) helps suppress damage to the joining area where the second end of the electrode bar is joined to the metallic foil in the sealing portion, as well as damage to the vicinity of the joining area. However, joining the second end of the electrode bar to the first end of the metallic foil is practically similar to joining two linear members to each other, which is difficult. Furthermore, when attaching the cylindrical member or the metallic coil to the second end of the electrode bar, the metallic foil may be deformed, or the first end of the metallic foil (to which the second end of the electrode bar is joined) may be ripped. In other words, the latter method is unfit for use in reality.

With the above problems taken into consideration, the present invention aims to provide a long-life high-pressure discharge lamp that (i) reliably suppresses damage to sealing portions, especially at an initial stage of the accumulated lighting time, (ii) allows for easy assembly of its components such as electrodes, and (iii) prevents defects such as deformation/ripping of metallic foils. The present invention also aims to provide a lamp unit using said high-pressure discharge lamp, and a projection type image display apparatus using said lamp unit.

Means to Solve the Problems

The present invention provides a high-pressure discharge lamp comprising an arc tube, which is a glass enveloping vessel with a pair of electrodes arranged therein, wherein: the arc tube includes (i) a light emitting portion in which (a) one or more materials are enclosed and (b) a discharge space is formed and (ii) a pair of sealing portions provided at respective ends of the light emitting portion; each electrode includes an electrode bar whose one end is joined to a surface of a corresponding one of metallic foils; the one end of each electrode bar is partially wrapped around by a corresponding one of sleeve-like metallic cover foils, each cover foil having a cut-out section that is positioned over a joining area where the one end of each electrode bar is joined to the surface of the corresponding metallic foil; and each cover foil and each metallic foil are in a corresponding one of the sealing portions, with the one end of each electrode bar partially wrapped around by the corresponding cover foil.

Of the above description, "the one end of each electrode bar is partially wrapped around by a corresponding one of sleeve-like metallic cover foils, each cover foil having a cut-out section that is positioned over a joining area where the one end of each electrode bar is joined to the surface of the corresponding metallic foil" encompasses the following notations. As long as the cut-out section is positioned over the joining area, an edge of the one end of each electrode bar may protrude from one edge of the corresponding cover foil, which is near the metallic foil, toward an outer end of the corresponding sealing portion. Contrarily, the edge of the one end of each electrode bar may be positioned between the two edges of the corresponding cover foil.

Furthermore, "each cover foil and each metallic foil are in a corresponding one of the sealing portions" encompasses the following notions. When the edge of the one end of each electrode bar protrudes from the one end of the corresponding cover foil toward the outer end of the corresponding sealing portion, the edge of the one end of each electrode bar may be in direct contact with the corresponding sealing portion, or a portion of each electrode bar that is in the cut-out section (i.e., an exposed portion of each electrode bar) may be in direct contact with the corresponding sealing portion. Alternatively, when the edge of the one end of each electrode bar is covered by a cover or the like, it may not be in direct contact with the corresponding sealing portion.

In the above high-pressure discharge lamp, neither electrode bar is fixed to the corresponding cover foil.

Here, being "fixed" denotes that the electrode bar and the cover foil are fixed to each other by welding or other fixing methods with the cover foil wrapped around the one end of the electrode bar. Accordingly, by "neither electrode bar is fixed to the corresponding cover foil", it means that the elect-rode bar and the cover foil are not welded/fixed to each other at all.

In the above high-pressure discharge lamp, one end of each cover foil that is closer to the corresponding metallic foil than another end thereof has been bent, so that the bent end of each cover foil latches onto an edge of the one end of the corresponding electrode bar. Alternatively, in the above-high-pressure discharge lamp, a portion of each cover foil may have been inserted between the one end of the corresponding electrode bar and the surface of the corresponding metallic foil.

In the above high-pressure discharge lamp, each cover foil is made of either (i) one of (a) molybdenum, (b) niobium, (c) rhenium, (d) tantalum and (e) tungsten, or (ii) an alloy whose major constituent is one of (a) through (e). Furthermore, in the above high-pressure discharge lamp, each cover foil may include a cover portion that covers the joining area from another surface of the corresponding metallic foil.

In the above high-pressure discharge lamp, each electrode bar may be substantially cylindrical in shape, except for the one end thereof, and a cross section of the one end of each electrode bar taken perpendicular to a longitudinal direction thereof may have a substantially semicircular shape.

The present invention also provides a lamp unit comprising the above high-pressure discharge lamp and a reflector having a concave reflective surface, wherein the high-pressure discharge lamp is built in the reflector so that light emitted from the high-pressure discharge lamp is reflected by the reflective surface.

The present invention also provides a projection type image display apparatus comprising: the above lamp unit; an optical unit operable to form an optical image by modulating light produced from the above lamp unit; and a projection device operable to magnify the optical image and project the magnified optical image.

Effects of the Invention

The long-life high-pressure discharge lamp of the present invention (i) reliably suppresses damage to the sealing portions, especially at an initial stage of the accumulated lighting time, (ii) allows for easy assembly of its components such as electrodes, and (iii) suppresses defects such as deformation/ripping of the metallic foils.

BRIEF DESCRIPTION OF THE DRAWING

FIG. 7 shows a test result, i.e., the probability of damage to the sealing portion when the accumulated lighting time has reached 100 hours and 2,000 hours;

FIGS. 12A, 12B and 12C exemplarily show variations of the cover foil, wherein FIG. 12A shows a cover foil wrapped around an electrode bar, as viewed from an angle where a cut-out section of the cover foil is visible, FIG. 12B shows the cover foil wrapped around the electrode bar, as viewed from a different angle, and FIG. 12C shows the cover foil wrapped around the electrode bar such that the cut-out section is positioned over a joining area where the electrode bar is joined to the metallic foil;

DESCRIPTION OF CHARACTERS

Figure 1:
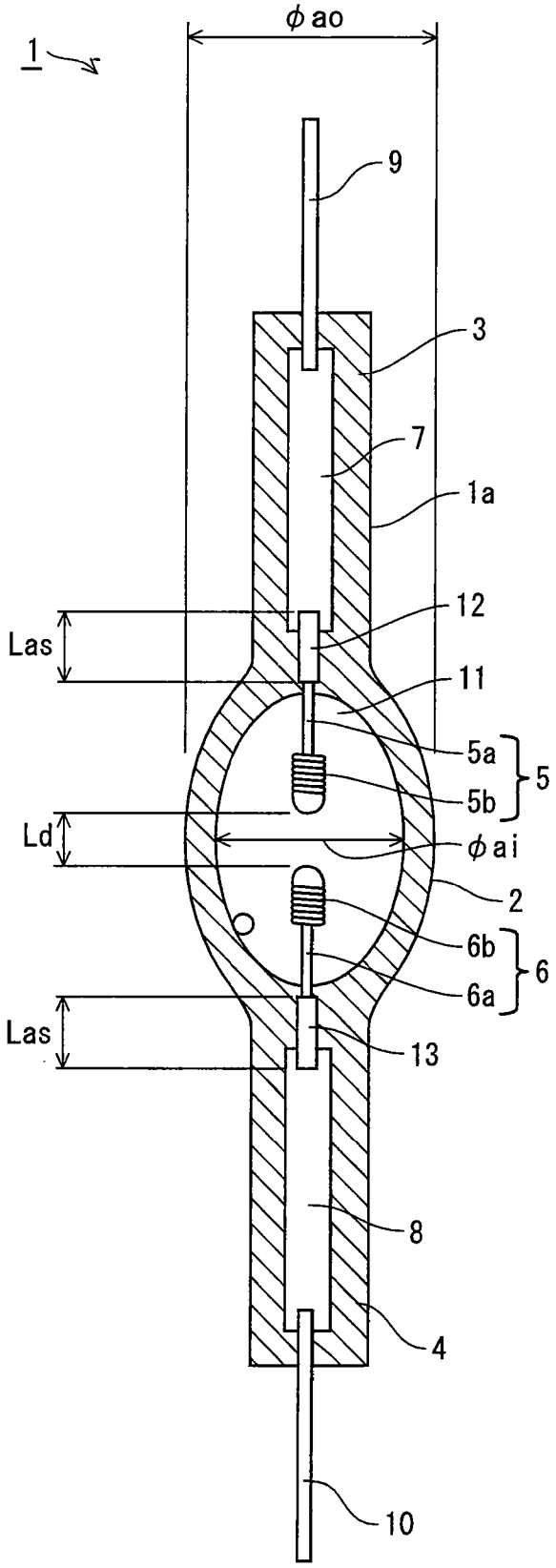
FIG. 1 is a cross-sectional front view showing the structure of an arc tube constituting a high-pressure mercury lamp pertaining to Embodiment 1 of the present invention.

1 arc tube
1*a* enveloping vessel
2 light emitting portion
3, 4 sealing portion
5, 6 electrode
5*a*, 6*a* electrode bar
7, 8 metallic foil
9, 10 outer lead wire
11 discharge space
12, 13 cover foil
12*a* cut-out section
21 lamp unit
22 high-pressure mercury lamp
23 reflective surface
24 reflector
24*a* neck portion
25 terminal
26 base
27 power supply wire
28 adhesive
29 open hole
30 front projector
31, 38 case
32 optical unit
33 control unit
34 projection lens
35 cooling fan unit
36 power source unit
37 rear projector
39 translucent screen
42 cover foil
42*b* cover portion

BEST MODES FOR CARRYING OUT THE INVENTION

The following describes best modes for carrying out the present invention in detail, with reference to the accompanying drawings. It should be mentioned that in each of the drawings referred to herein, components and distances therebetween are depicted in various degrees of scale. Some elements, such as the positions of edges of a sleeve-like metallic cover foil (12*c*), are depicted differently in FIGS. 3 to 6 (FIG. 4 in particular) than in other drawings in order to illustrate a cut-out section.

Embodiment 1

1. Structure of Arc Tube

FIG. 1 shows the structure of an arc tube 1 constituting a high-pressure mercury lamp pertaining to Embodiment 1 of the present invention, the high-pressure mercury lamp having a rated power of 300 [W].

The arc tube 1 is an enveloping vessel 1*a* made of glass (e.g., fused quartz) in which electrodes 5 and 6 are arranged. The arc tube 1 includes (i) a light emitting portion 2 that is in the center of the arc tube 1 and substantially spheroidal in shape, and (ii) sealing portions 3 and 4 each of which is substantially cylindrical in shape and connected to the light emitting portion 2, in such a manner that the sealing portions 3 and 4 extend from sides of the light emitting portion 2 outward in opposite directions. Enclosed in the arc tube 1 are (i) mercury (Hg) functioning as light emitting material, (ii) noble gases such as argon gas (Ar) for starter assistance, and (iii) materials such as bromine (Br) for the working of the halogen cycle, each by a predetermined amount. The sealing portions 3 and 4 have been sealed using a conventional shrink seal method.

The arc tube 1 is constructed as follows, for example. The inner diameter ϕai and the outer diameter ϕao (see FIG. 1) of the center of the light emitting portion 2 are 5 [mm] and 12 [mm], respectively. The cubic capacity of the light emitting portion 2 is 0.1 [$cm^3$]. The amount of mercury enclosed is 0.15 [$mg/mm^3$]to 0.35 [$mg/mm^3$], inclusive (in the present embodiment, 0.35 [$mg/mm^3$]). The amounts of argon gas and bromine enclosed are 30 [kpa] (25[° C.]) and $0.5\times10^{-3}$ [μmol], respectively.

A discharge space 11 is formed in the light emitting portion 2. A pair of electrodes 5 and 6 is partially exposed to the discharge space 11, in such a manner that a first end of the electrode 5 and a first end of the electrode 6 are in opposition to each other. The pair of electrodes 5 and 6 is made of, for example, tungsten (W). The distance Ld between the electrodes 5 and 6 (see FIG. 1) is 0.5 [mm] to 2.0 [mm], inclusive (in the present embodiment, 1.2 [mm]).

The first end portions of the electrodes 5 and 6 are exposed to the discharge space 11. The second end portions of the electrodes 5 and 6 are respectively connected to first ends of outer lead wires 9 and 10, via strips of rectangular metallic foils 7 and 8 that are hermetically sealed in the sealing portions 3 and 4, respectively. Second ends of the outer lead wires 9 and 10 are respectively protruding from outer ends of the sealing portions 3 and 4. The second ends of the outer lead wires 9 and 10 are also connected to power supply wires, bases, etc. (not illustrated).

The electrodes 5 and 6 have electrode bars 5*a* and 6*a* and electrode coils 5*b* and 6*b*, respectively. First ends of the electrode bars 5*a* and 6*a* are in the discharge space 11. Second ends of the electrode bars 5*a* and 6*a* are respectively joined to the metallic foils 7 and 8 by, for example, welding. The electrode coils 5*b* and 6*b* are respectively attached to the first ends of the electrode bars 5*a* and 6*a*. Each of the electrode bars 5*a* and 6*a* is, for example, substantially cylindrical in shape. A cross section of each of the electrode bars 5*a* and 6*a* has a substantially circular shape.

Figure 2:
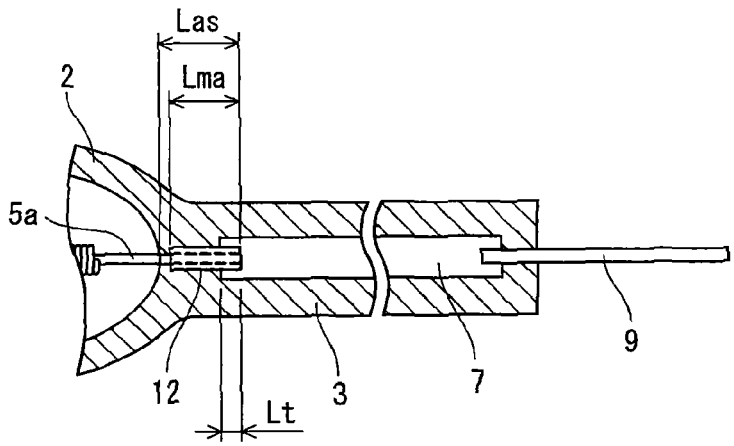
FIG. 2 is a cross-sectional front view showing a part of the structure of the arc tube.

FIG. 2 is a cross-sectional front view showing one side of the arc tube 1. Note, the other side of the arc tube 1 has the same structure.

As shown in FIG. 2, the electrode bar 5*a* is joined to the metallic foil 7 by welding in such a manner that the second end of the electrode bar 5*a* overlaps the metallic foil 7 by 1.0 [mm]to 1.5 [mm], inclusive (in the present embodiment, approximately 1.2 [mm]) (i.e., the length indicated by Lt in FIG. 2).

As shown in FIGS. 1 and 2, portions of the electrode bars 5*a* and 6*a* that are embedded in the sealing portions 3 and 4 are, at least partially, wrapped around by sleeve-like metallic cover foils 12 and 13, respectively (within an area Las shown in FIG. 2).

Figure 3A:
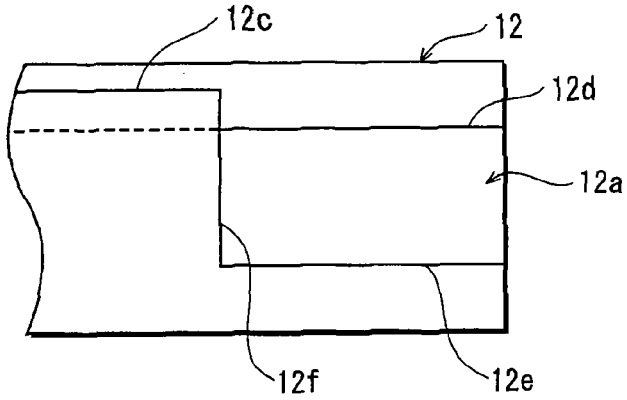
FIG. 3A shows a cover foil as viewed from an angle where a cut-out section of the cover foil is visible.
Figure 3B:
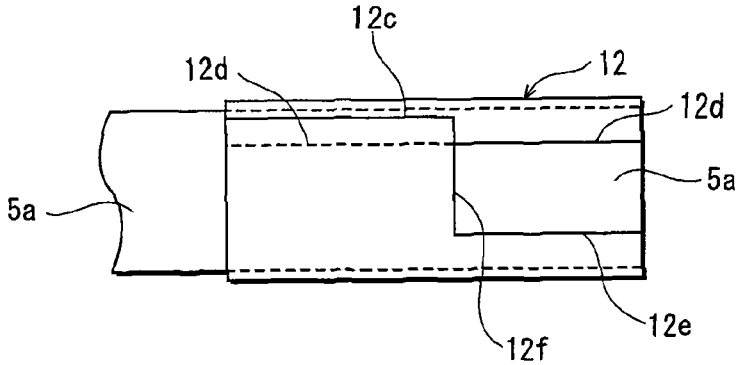
FIG. 3B is an enlarged view of an electrode bar wrapped around by the cover foil, as viewed from an angle where the cut-out section is visible.

FIG. 3A shows the cover foil 12 as viewed from an angle where a cut-out section 12*a* of the cover foil 12 is visible. FIG. 3B is an enlarged view of the electrode bar 5*a* wrapped around by the cover foil 12, as viewed from said angle where the cut-out section 12*a* is visible.

Figure 4:
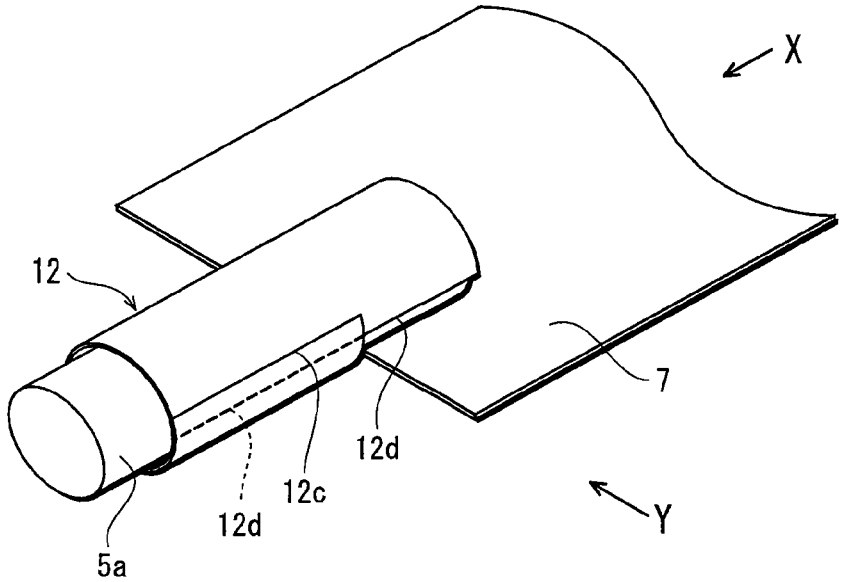
FIG. 4 is an enlarged perspective view of a joining area where the electrode bar is joined to a metallic foil.
Figure 5:
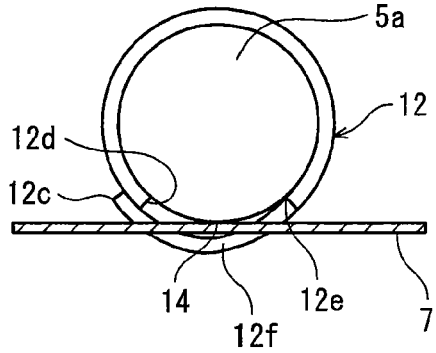
FIG. 5 shows the joining area of FIG. 4 as viewed in the direction of X.
Figure 6:
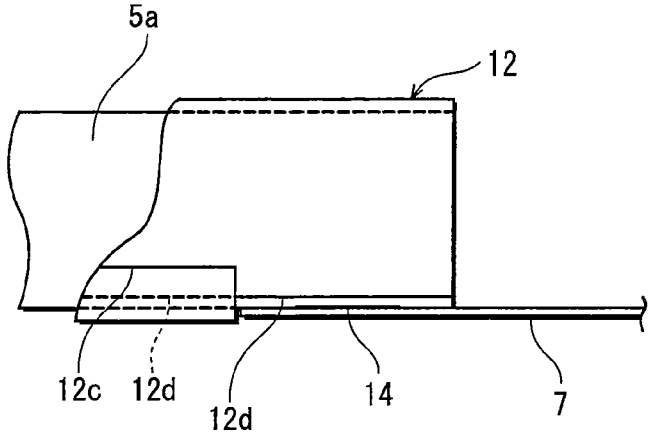
FIG. 6 shows the joining area of FIG. 4 as viewed in the direction of Y.

FIG. 4 is an enlarged perspective view of a joining area where the electrode bar 5*a* is joined to the metallic foil 7. FIG. 5 shows the joining area of FIG. 4 as viewed in the direction of X. FIG. 6 shows the joining area of FIG. 4 as viewed in the direction of Y.

It should be noted that the other electrode bar 6*a* is structured the same as the electrode bar 5*a* shown in FIGS. 4 through 6.

As shown in FIG. 3A, the cover foil 12 (13) includes the cut-out section 12*a* (13*a*) that is to be positioned over a contacting area where the second end of the electrode bar 5*a* (6*a*) comes in contact with the metallic foil 7 (8) when wrapped around by the cover foil 12 (13). The contacting area includes the joining area where the second end of the electrode bar 5*a* (6*a*) is joined to the metallic foil 7 (8). As stated above, the second end of the electrode bar 5*a* (6*a*) is an end opposite to the first end of the electrode bar 5*a* (6*a*) to which the electrode coil 5*b* (6*b*) is attached.

The second end of the electrode bar 5*a* (6*a*) is fit in the cover foil 12 (13) in such a manner that its cut-out section 12*a* (13*a*) is positioned over the contacting area where the second end of the electrode bar 5*a* (6*a*) comes in contact with the metallic foil 7 (8), the contacting area including the joining area (welding area) where the second end of the electrode bar 5*a* (6*a*) is joined to the metallic foil 7 (8) by welding. That is to say, as shown in FIGS. 2 and 4, the second end of the electrode bar 5*a* (6*a*) that lies on and is joined to the surface of the metallic foil 7 (8) is partially wrapped around by the cover foil 12 (13).

Although the cover foil 12 (13) is wrapped around the electrode bar 5*a* (6*a*), the cover foil 12 (13) and the electrode bar 5*a* (6*a*) are not fixed to each other by, for example, welding. This way, the entirety of the cover foil 12 (13) stretches.

As exemplarily shown in FIG. 2, Las is 2.5 [mm] to 4.0 [mm], inclusive (in the present embodiment, 3.8 [mm]). Lma, which is a length of a portion of the electrode bar 5*a* (6*a*) that is wrapped around by the cover foil 12 (13), is 3.5 [mm]. The length Lma is the distance measured from (i) the edge of the second end of the electrode bar 5*a* (6*a*) which is joined to the metallic foil 7 (8), to (ii) a point on the electrode bar 5*a* (6*a*) that is 3.5 [mm] away from the edge of the second end of the electrode bar 5*a* (6*a*) toward the first end of the electrode bar 5*a* (6*a*). That is to say, in the present embodiment, the cover foil 12 (13) is wrapped around the second end of the electrode bar 5*a* (6*a*), in such a manner that the edge of the second end of the electrode bar 5*a* (6*a*) is substantially flush with one edge of the cover foil 12 (13) that is near the metallic foil.

The cover foil 12 (13) is made from a sheet of foil having a thickness of 10 [μm] to 40 [μm], inclusive (in the present embodiment, 20 [μm]). The cover foil 12 (13) is formed by, for example, rolling the sheet of foil once to wrap around the electrode bar 5*a* (6*a*).

2. Sealing Portions

The arc tube 1 is formed by sealing the enveloping vessel 1*a* using a shrink seal method with the electrodes 5 and 6 arranged in predetermined positions in the enveloping vessel 1*a*. More specifically, two electrode assemblies are sealed in the sealing portions 3 and 4 of the enveloping vessel 1*a*, each electrode assembly being constructed by joining the electrode 5 (6) (composed of the electrode coil and the electrode bar), the metallic foil 7 (8), and the outer lead wire 9 (10) to one another.

The electrode 5 (6) is joined to the metallic foil 7 (8) in the following manner. First, the cover foil 12 (13) is wrapped around the second end of the electrode bar 5*a* (6*a*), whose first end is attached to the electrode coil 5*b* (6*b*). Then, the second end of the electrode bar 5*a* (6*a*) is joined to a surface of the metallic foil 7 (8) by welding so that it lies on the surface of the metallic foil 7 (8). During this welding process, the cover foil 12 (13) wrapped around the electrode bar 5*a* (6*a*) needs to be temporarily positioned toward the electrode coil 5*b* (6*b*), so that it is kept off the welding area were the electrode 5 (6) is joined to the metallic foil 7 (8) by welding.

After the welding process, the cover foil 12 (13) is slid toward the metallic foil 7 (8) along the electrode bar 5*a* (6*a*). Consequently, the cover foil 12 (13) covers the joining area where the electrode bar 5*a* (6*a*) has been joined to the metallic foil 7 (8). Here, the cover foil 12 (13) has the cut-out section 12*a* (13*a*); accordingly, by simply sliding the cover foil 12 (13) so that the cut-out section 12*a* (13*a*) is positioned over the welding area, the cover foil 12 (13) can easily cover not only the second end of the electrode bar 5*a* (6*a*), but also one end of the metallic foil 7 (8) that is closer to the electrode coil 5*b* (6*b*) than the other end thereof. This completes the welding process of joining the electrode 5 (6) to the metallic foil 7 (8).

Lastly, each electrode assembly is completed by welding the outer lead wire 9 (10) to the second end of the metallic foil 7 (8), which is opposite to the first end of the metallic foil 7 (8) to which the electrode bar 5*a* (6*a*) is joined.

It should be mentioned that the above-described method of constructing the electrode assemblies is merely an example. The electrode assemblies may be constructed by, for example, performing the following in listed order: welding electrode bars with no electrode coils to metallic foils; wrapping cover foils around the electrode bars; and attaching the electrode coils to the electrode bars. Alternatively, the electrode assemblies may also be constructed by performing the following in listed order: welding outer lead wires to metallic foils; and welding electrode bars, around which cover foils have been wrapped, to the metallic foils.

As set forth above, the cover foil 12 (13) is wrapped around the electrode bar 5*a* (6*a*). That is to say, the entire inner circumferential surface of the cover foil 12 (13) is substantially in contact with the outer circumferential surface of a portion of the electrode bar 5*a* (6*a*). Therefore, until the electrode 5 (6) (electrode assembly) is sealed, the friction resistance between the metallic inner circumferential surface of the cover foil 12 (13) and the metallic outer circumferential surface of the electrode bar 5*a* (6*a*) can prevent the cover foil 12 (13) from easily sliding off its predetermined position on the electrode bar 5*a* (6*a*), despite the fact that the cover foil 12 (13) is not joined to the electrode bar 5*a* (6*a*). Hence, the electrode assemblies can easily be sealed in the enveloping vessel 1*a*.

If the cover foil 12 (13) has been wrapped around the second end of the electrode bar 5*a* (6*a*) during the welding process of joining the electrode bar 5*a* (6*a*) to the metallic foil 7 (8) by resistance welding or the like, not only the electrode bar 5*a* (6*a*), but also the cover foil 12 (13) will be welded to the metallic foil 7 (8). This results in the electrode bar 5*a* (6*a*) being fixed to the cover foil 12 (13) by welding.

To avoid this problem in the manufacturing process, an unconventional, cumbersome process would be required.

In light of this problem, the aforementioned sleeve-like cover foil 12 (13) having the cut-out section 12*a* (13*a*) is proposed. First, the cover foil 12 (13) is wrapped around the electrode bar 5*a* (6*a*) in advance, so that it is temporarily positioned toward the first end of the electrode bar 5*a* (6*a*). Then, the second end of the electrode bar 5*a* (6*a*) is joined to the surface of the metallic foil 7 (8) by resistance welding or the like. Thereafter, the cover foil 12 (13) is slid so that the cut-out section 12*a* (13*a*) is positioned over the joining area where the second end of the electrode bar 5*a* (6*a*) is joined to the surface of the metallic foil 7 (8). This way, a portion of the electrode bar 5*a* (6*a*) that lies on the metallic foil 7 (8) is partially wrapped around by the cover foil 12 (13). With this technique, the aforementioned cumbersome process is not required.

Unlike conventional technologies (Patent Documents 2 and 3), use of the aforementioned sleeve-like cover foil 12 (13) does not require the width of the first end of the metallic foil 7 (8) to be reduced before placing the cover foil 12 (13) around the joining area where the electrode bar 5*a* (6*a*) is joined to the surface of the metallic foil 7 (8). With use of such a cover foil 12 (13), the electrode bar 5*a* (6*a*) can be joined to the metallic foil 7 (8) using a conventional joining method, i.e., at the same difficulty level as conventional technologies. In addition, the following defects can be prevented at the time of wrapping such a cover foil 12 (13) around the electrode bar 5*a* (6*a*): deformation of the metallic foil 7 (8); and ripping of the metallic foil 7 (8) in the joining area.

3. Manufacturing of Cover Foils

Each of the cover foils 12 and 13 is formed by rolling a single sheet of foil (hereinafter, "foil sheet") once into a sleeve-like shape. As the cover foils 12 and 13 are manufactured using the same manufacturing method, the following only describes an exemplary method of manufacturing the cover foil 12.

First, a portion (corresponding to the cut-out section 12*a*) of a foil sheet is removed in advance. In the present embodiment, one corner of the foil sheet is removed in advance in the shape of a square (note, the area of the removed corner is greater than that of the cut-out section 12*a*). After said one corner has been removed from the foil sheet in the shape of a square, the foil sheet has two edges along which the corner has been removed; the reference numbers "12*e*" and "12*f*" are given to these edges.

Next, the foil sheet is rolled into a sleeve-like shape, such that the edge 12*c* of the sleeve-like foil crosses over the edge 12*d* thereof, the edges 12*c* and 12*d* being (i) parallel to an axis of the rolled foil sheet and (ii) perpendicular to the direction in which the foil sheet has been rolled.

This way, the cut-out section 12*a* is formed in a certain area of the cover foil 12, enclosed by the edges 12*d*, 12*e* and 12*f* as shown in FIG. 3A.

Referring to FIGS. 3A through 6, the edges 12*d* and 12*c* of the unrolled sleeve foil are both perpendicular to the rolling direction. The edge 12*d* is an edge of the unrolled foil sheet that is the other side of said one corner—i.e., said one corner is not removed along any part of the edge 12*d*. On the other hand, the edge 12*c* is an edge of the unrolled foil sheet, and a part of the edge 12*c* has been cut off with the removal of said one corner.

4. Advantages (1) Formation of Cracks

Figure 13:
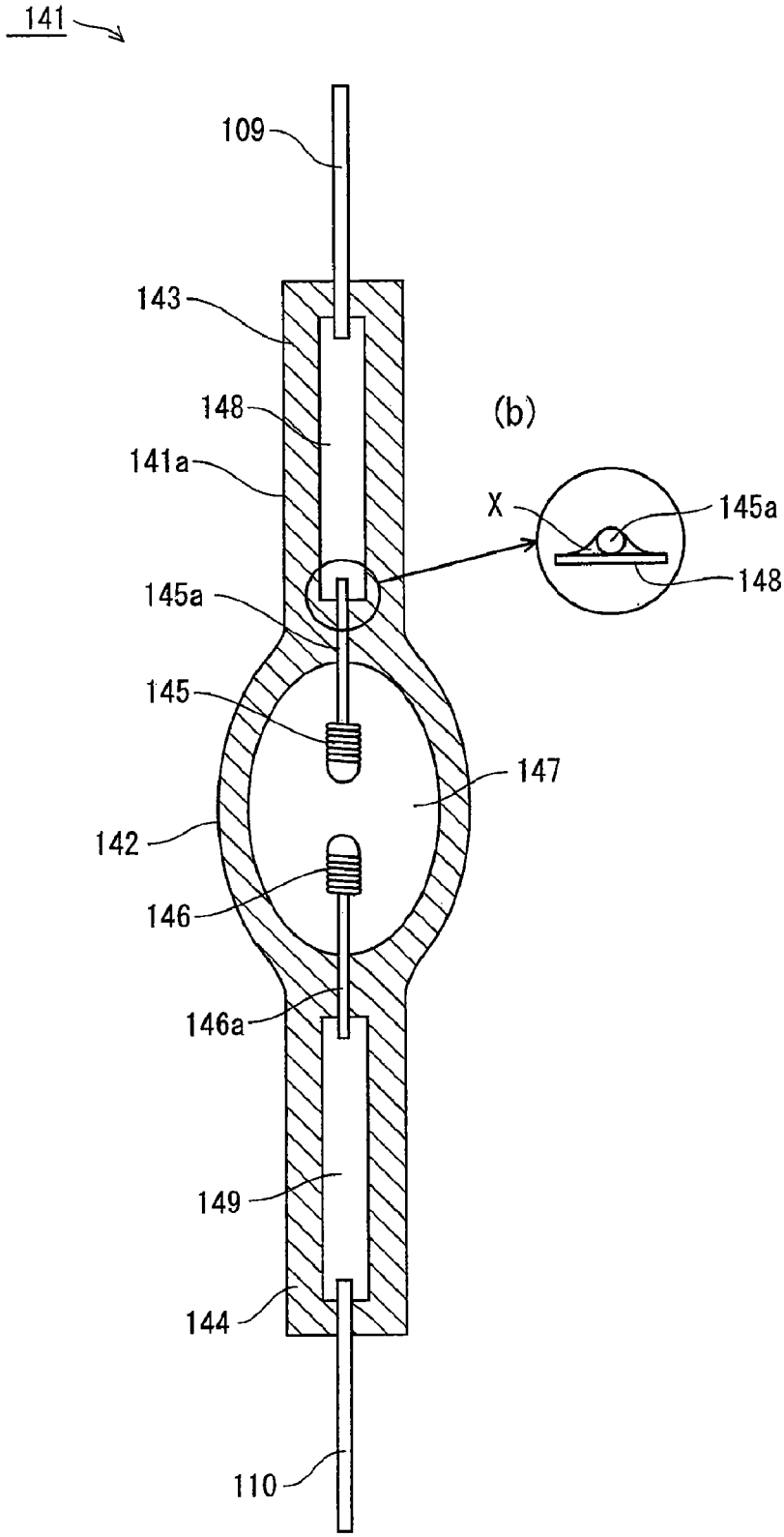
FIG. 13A is a cross-sectional front view showing the structure of an arc tube constituting a conventional high-pressure mercury lamp.
FIG. 13B is an enlarged cross-sectional view of major components of the arc tube.

As set forth above, according to the structure of the high-pressure mercury lamp pertaining to Embodiment 1, the fused quartz and the electrode bar 5*a* (6*a*) in the sealing portion 3 (4) are in indirect contact with each other with the sleeve-like cover foil 12 (13) in between. This way, the cover foil 12 (13) (i) functions as a stretchable cushion, (ii) significantly reduces (absorbs) the stress applied to the sealing portion 3 (4), the stress being caused by the difference between the coefficient of thermal expansion of the sealing portion 3 (4) and the coefficient of thermal expansion of the electrode bar 5*a* (6*a*), and (iii) during the sealing process, efficiently prevents small cracks from forming in an area of the sealing portion 3 (4) where the stated stress is applied. As explained earlier, in the high-pressure mercury lamp of Embodiment 1, the second end of the electrode bar 5*a* (6*a*) that lies on the metallic foil 7 (8) is partially wrapped around by the cover foil 12 (13). Therefore, although relatively large cracks tend to easily form around a portion of the electrode bar 5*a* (6*a*) that is exposed to the clearance X (see FIG. 13), such relatively large cracks can be prevented from forming in the high-pressure mercury lamp of Embodiment 1.

Since the electrode bar 5*a* (6*a*) is not fixed to the sleeve-like cover foil 12 (13), the entirety of the cover foil 12 (13) can stretch. This, in particular, helps prevent formation of small cracks quite notably.

The aforementioned structures can reliably suppress damage to the sealing portion 3 (4), especially at an initial stage of the accumulated lighting time, and extend the life of the lamp. Even in a case where the stress is produced by increasing the amount of mercury enclosed and raising the vapor pressure in the arc tube 1 during illumination, use of the cover foil 12 (13) can not only alleviate such stress, but also prevent small cracks from growing if they ever form. For the above reasons, damage to the sealing portions 3 and 4 can be reliably suppressed.

The following describes an experiment that has been conducted to confirm the operation effect of the high-pressure mercury lamp pertaining to Embodiment 1.

Figure 8:
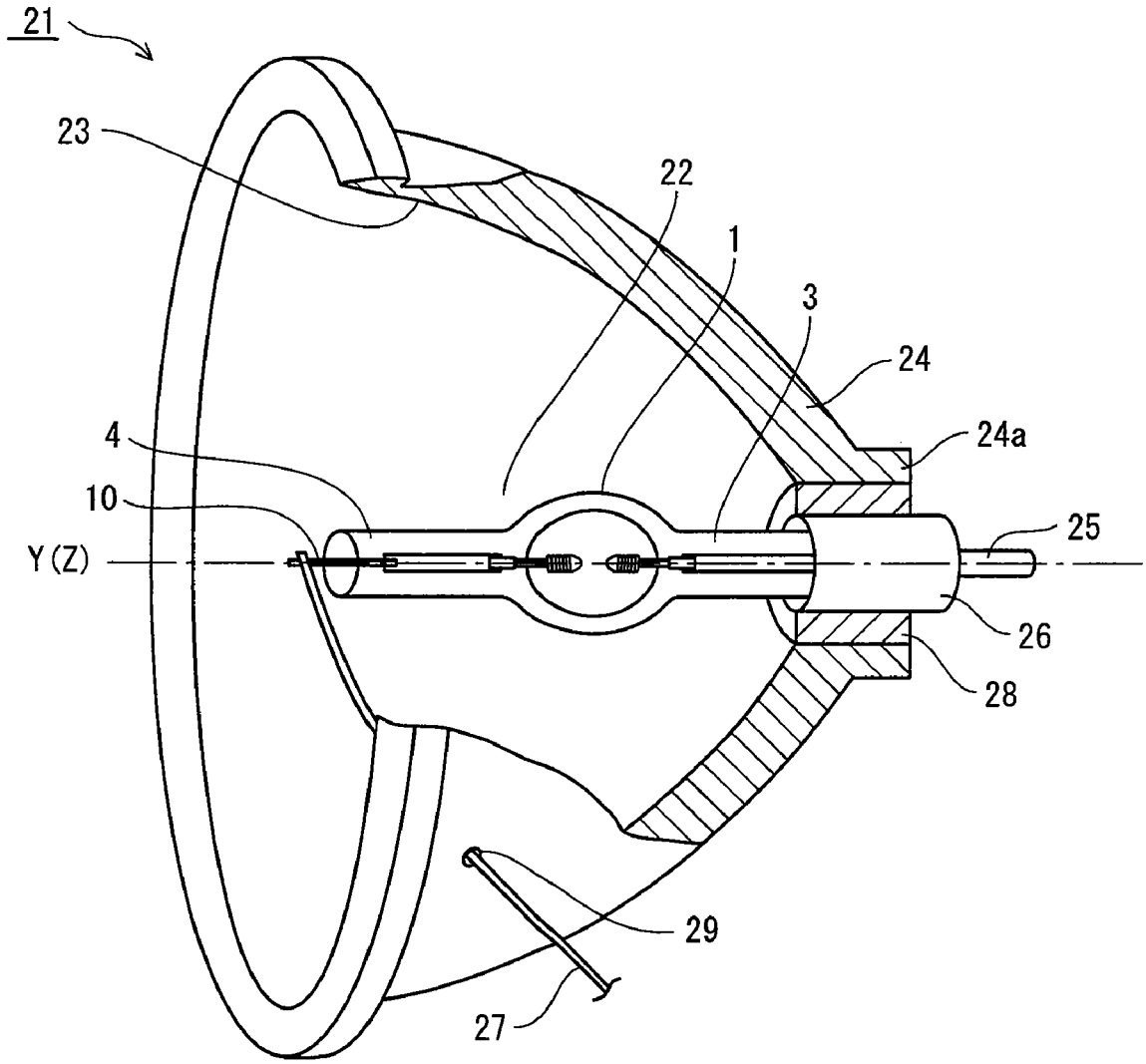
FIG. 8 is a partially cut-away perspective view showing the structure of a lamp unit pertaining to Embodiment 2 of the present invention.

Inventors of the present invention performed life tests on high-pressure mercury lamps pertaining to Embodiment 1 (hereafter, "embodiment specimens 1"), each of the embodiment specimens 1 being built in a different one of lamp units (finished products) shown in the after-mentioned FIG. 8. The inventors studied conditions of damage to the sealing portions 3 and 4 of the arc tube 1.

FIG. 7 shows a test result, i.e., the probability of damage to the sealing portions 3 and 4 when the accumulated lighting time has reached 100 hours and 2,000 hours. More specifically, FIG. 7 shows how many specimens had their sealing portions 3 and 4 damaged out of all the specimens, when the accumulated lighting time had reached 100 hours and 2,000 hours.

For the sake of comparison, the inventors manufactured high-pressure mercury lamps (hereafter, "comparative specimens 1") each having the same structure as the high-pressure mercury lamp pertaining to Embodiment 1, except for the following difference: in each of the electrode assemblies arranged in the comparative specimens 1, the sleeve-like cover foil had a joining area where the second end of the electrode bar was joined to the sleeve-like cover foil by resistance welding (in other words, the electrode bar was fixed at one portion thereof to the sleeve-like cover foil). The inventors also conducted life tests on these comparative specimens 1 under the same conditions as the embodiment specimens 1, the result of which is also shown in FIG. 7.

The life tests were performed under the following conditions. While lying horizontally, each arc tube 1 was first lit constantly for three consecutive hours with a rated power of 300 W and a square-wave current having a frequency of 100 Hz, and then turned off for half an hour. This illumination on/off cycle was repeated. The numbers of the embodiment specimens 1 and the comparative specimens were 100 each.

As shown in FIG. 7, out of the hundred embodiment specimens 1, none had their sealing portions 3 and 4 damaged when the accumulated lighting time reached 100 hours. In contrast, out of the hundred comparative specimens 1, three specimens had their sealing portions 3 and 4 damaged when the accumulated lighting time reached 100 hours. Thereafter, neither the embodiment specimens 1 nor the comparative specimens 1 had their sealing portions 3 and 4 damaged when the accumulated lighting time reached 2,000 hours.

The following has been confirmed from the result of the above experiment. The embodiment specimens 1 can significantly alleviate the stress applied to the sealing portions 3 and 4 especially at an initial stage of the accumulated lighting time, the stress being caused by the difference between (i) the coefficient of thermal expansion of the sealing portions 3 and 4 and (ii) the coefficient of thermal expansion of the constituents of the electrode bars 5*a* and 6*a*. The embodiment specimens 1 can also prevent damage to the sealing portions 3 and 4 caused by small cracks.

(2) Life

By forming the cover foils 12 and 13 (wrapped around the electrode bars 5*a* and 6*a*) into a sleeve-like shape, it is possible to suppress the mercury from entering (i) the inside of the cover foils 12 and 13, or (ii) between the cover foils 12 and 13 and the electrode bars 5*a* and 6*a*.

More specifically, when a metallic coil is attached to each electrode bar, the mercury enters the gaps formed between loops of the coil. As opposed to this, a sleeve-like cover foil does not have such gaps; therefore, wrapping the sleeve-like cover foil to each electrode bar can suppress the mercury from entering the inside of the cover foil (or reduce the amount of the mercury entering the inside of the cover foil). Since the cover foil is thin, formation of cracks can be prevented even if the clearance between the sleeve-like cover foil and the electrode bar is reduced (e.g., even if the inner diameter of the sleeve-like foil is made smaller than the outer diameter of the electrode bar.

It should be noted that if the mercury permeates parts of the lamp other than the discharge space, the amount of the mercury within the discharge space will naturally be reduced, which consequently increased the lamp current. As a result, tips of the electrodes (e.g., the electrode coils) wear fast and the life of the lamp is shortened.

Embodiment 2

FIG. 8 shows a lamp unit 21 pertaining to Embodiment 2 of the present invention. The lamp unit 21 includes: a high-pressure mercury lamp 22 comprising the art tube 1 of Embodiment 1 described above; and a reflector 24 whose body is made of glass. The inner concave surface of the body of the reflector 24 is a reflective surface 23. The high-pressure mercury lamp 22 is built in the reflector 24 such that the central axis Y (see FIG. 8) of the high-pressure mercury lamp 22 in the longitudinal direction thereof is substantially in line with the optical axis Z (see FIG. 8) of the reflector 24. This way the light emitted from the high-pressure mercury lamp 22 is reflected by the reflective surface 23.

The sealing portion 3 (one end) of the arc tube 1 constituting the high-pressure mercury lamp 22 is inserted in a base 26 that is cylindrical in shape and attached to a terminal 25 for connecting to the power source. The outer lead wire 9 (not illustrated) of the arc tube 1 is connected to terminal 25. The other outer lead wire 10 of the arc tube 1 is connected to a power supply wire 27.

The base 26 is inserted in a neck portion 24*a* of the reflector 24, and fixed in place to the neck portion 24 by an adhesive 28. The power supply wire 27 is penetrated through an open hole 29 formed in the reflector 24.

The reflective surface 23 is, for example, spheroidal or paraboloidal in shape. A multi-layered film or the like is deposited on the reflective surface 23.

As described above, the structure of the lamp unit 21 pertaining to Embodiment 2 can reliably suppress damage to the sealing portions 3 and 4 of the arc tube 1, especially at an initial stage of the accumulated lighting time. Consequently, the lamp unit 21 has a long life.

Embodiment 3

Figure 9:
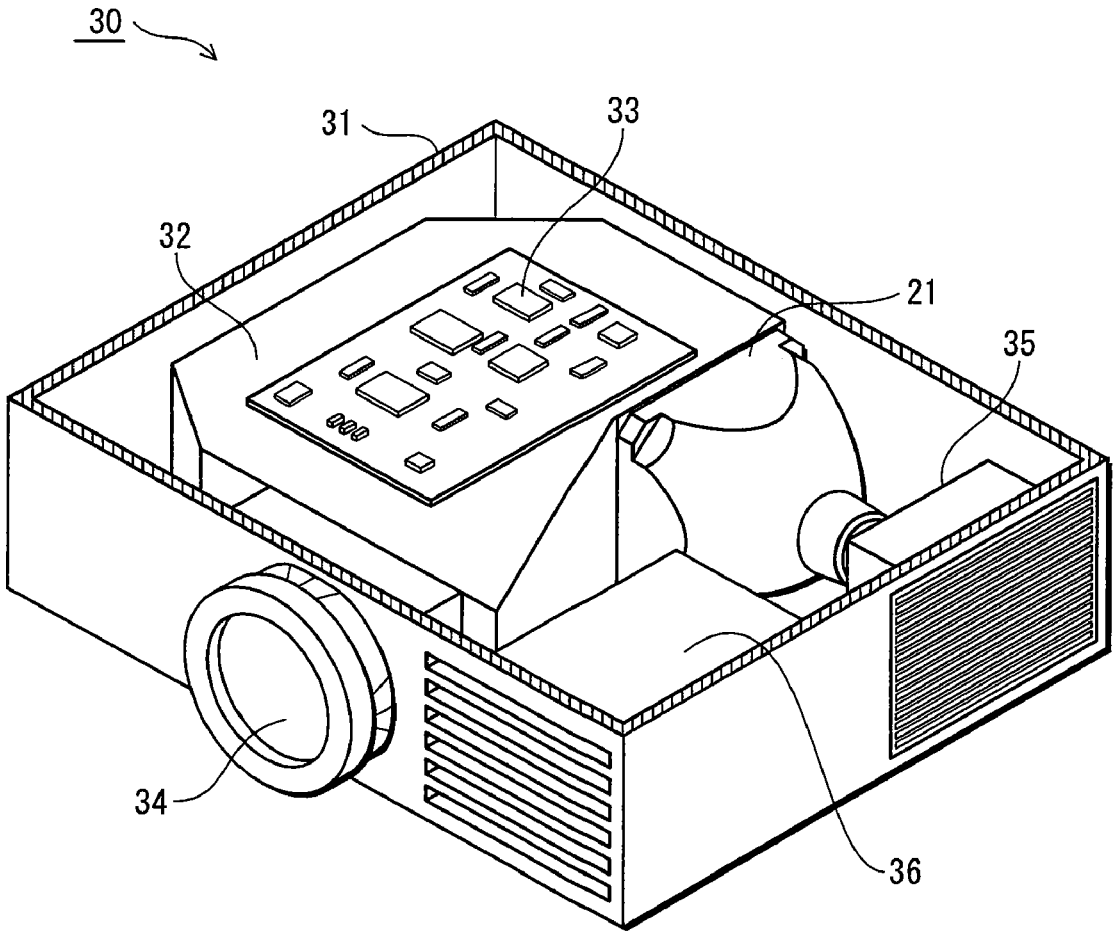
FIG. 9 is a partially cut-away perspective view showing the structure of a front projector, which is one example of a projection type image display apparatus pertaining to Embodiment 3 of the present invention.
Figure 10:
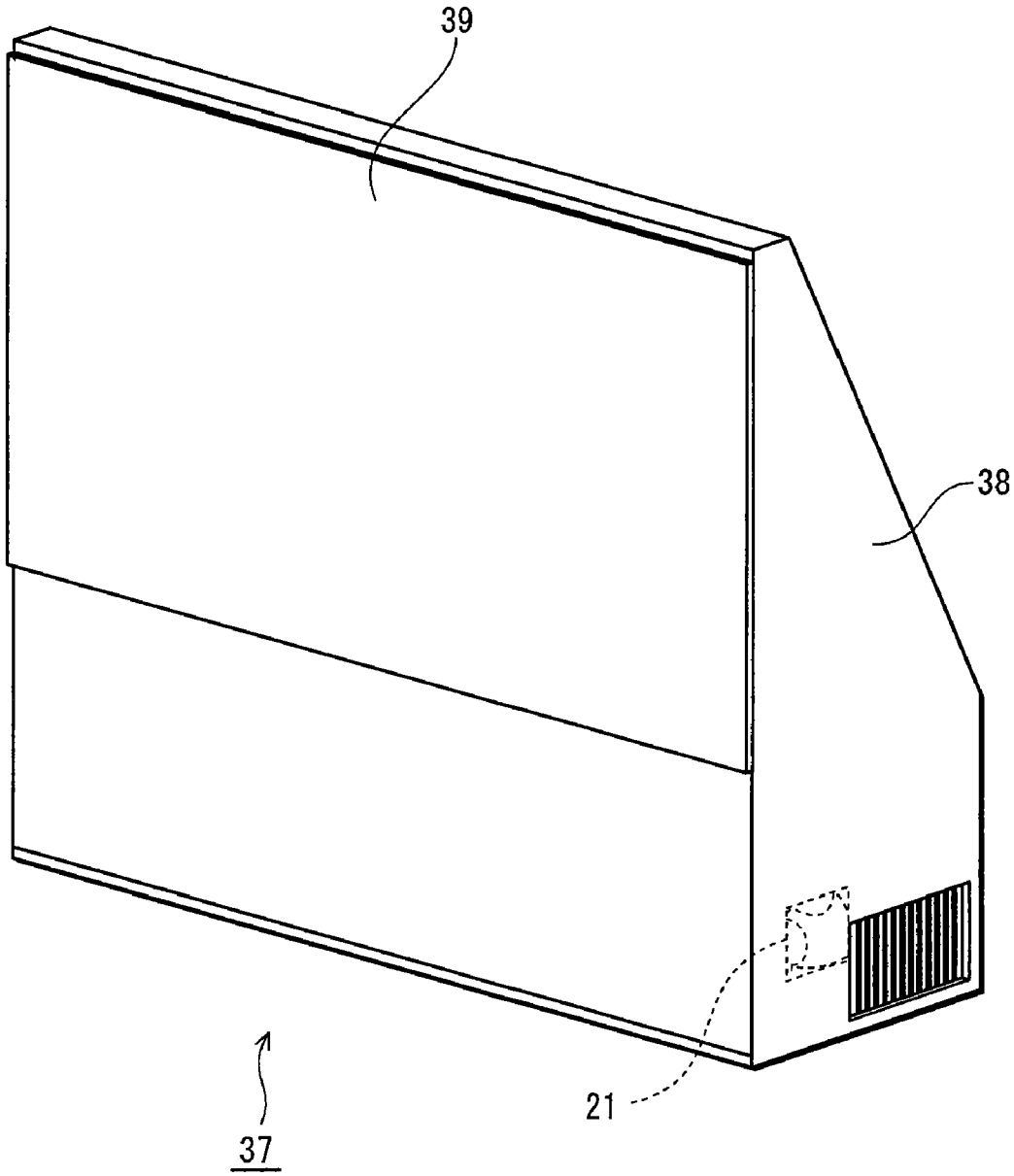
FIG. 10 is a perspective view showing the structure of a rear projector, which is another example of the projection type image display apparatus.

With reference to FIGS. 9 and 10, the following describes a projection type image display apparatus pertaining to Embodiment 3 of the present invention.

FIG. 9 shows an overview of the structure of a front projector 30, which is one example of a projection type image display apparatus using the lamp unit 21 of Embodiment 2. The front projector 30 is a projector that projects an image on a screen (not illustrated) placed in front of it.

FIG. 9 shows the front projector 30 with a top panel of its case 31 (described later) removed.

The front projector 30 has the case 31 in which the following constituent elements are contained: the lamp unit 21 which functions as a light source; an optical unit 32; a control unit 33; a projection lens 34; a cooling fan unit 35; a power source unit 36; and the like. The optical unit 32 includes: an image formation unit that forms an image by modulating light that has been input thereto; and an illumination unit that inputs light emitted by the lamp unit 21 to the image formation unit (neither of them are illustrated). The illumination unit includes, for example, color wheels (not illustrated) comprising color filters of three different colors. When inputting the emitted light to the image formation unit, the illumination unit separates the emitted light into lights of three primary colors. The control unit 33 drives/controls the image formation unit and the like. The projection lens 34 magnifies the optical image formed by the image formation unit modulating the light input, and projects the magnified optical image. The power source unit 36 converts power supplied from a commercial power supply into powers suited for the control unit 33 and lamp unit 21, and supplies the converted powers to the control unit 33 and lamp unit 21.

The lamp unit 21 may also be used as a light source for a rear projector 37 shown in FIG. 10, which is another example of a projection type image display apparatus. The rear projector 37 has a case 38 in which the following constituent elements are contained: the lamp unit 21; an optical unit; a projection lens; a mirror; and the like (none of these is illustrated). In the rear projector 37, an image projected by the projection lens is reflected by the mirror. Then the reflected image is projected from the back side of a translucent screen 39 and displayed.

With the above structures, the projection type image display apparatuses of Embodiment 3 have a long life.

(Variations)

1. Electrode Bars and Cover Foils

According to Embodiment 1, the edge of the second end of the electrode bar 5*a* (6*a*) is substantially flush with one edge of the cover foil 12 (13) that is near the metallic foil 7 (8) (i.e., they are substantially on the same point on the axis of the electrode bar 5*a* (6*a*)). Note, the present invention aims to suppress formation of cracks originating from the vicinity of the electrode bars and the metallic foils, the cracks being caused by the difference between the coefficient of thermal expansion of the electrode bars and the coefficient of thermal expansion of the sealing portions. In view of this, it is preferable that the edge of the second end of the electrode bar 5*a* (6*a*) does not protrude from said one edge of the cover foil 12 (13) toward the outer lead wire 9 (10). Therefore, the cover foil 12 (13) may be wrapped around the electrode bar 5*a* (6*a*) such that said one edge of the cover foil 12 (13) is closer to the outer lead wire 9 (10) than the edge of the second end of the electrode bar 5*a* (6*a*) is.

Note, when the edge of the second end of the electrode bar 5*a* (6*a*) protrudes from said one edge of the cover foil 12 (13) toward the outer lead wire 9 (10) by approximately 0.2 mm, the cover foil 12 (13) can still suppress the edge of the second end of the electrode bar 5*a* (6*a*) from coming into contact with the fused quartz, and accordingly formation of significant cracks originating from the vicinity of the second end of the electrode bar 5*a* (6*a*) can be suppressed. Hence, it is allowed for the edge of the second end of the electrode bar 5*a* (6*a*) to protrude from said one edge of the cover foil 12 (13) toward the outer lead wire 9 (10) by approximately 0.2 mm.

2. Cover Foils (1) Material

In the above embodiments, the cover foils 12 and 13 are made of molybdenum. However, in terms of thermostability, it is preferable that the cover foils 12 and 13 be made of either (i) one of (a) molybdenum, (b) niobium, (c) rhenium, (d) tantalum and (e) tungsten, or (ii) an alloy whose major constituent is one of (a) through (e).

(2) Fixing

In the above embodiments, the cover foil 12 (13) and the electrode bar 5*a* (6*a*) are not fixed to each other. The friction between the cover foil 12 (13) and the electrode bar 5*a* (6*a*), or the springback of the cover foil 12 (13), can prevent the cover foil 12 (13) from sliding off its predetermined position on the electrode bar 5*a* (6*a*). However, this sliding may be prevented using different methods.

For example, the sliding may also be prevented by (i) wrapping the sleeve-like cover foil 12 (13) around the second end of the electrode bar 5*a* (6*a*) so that said one edge of the sleeve-like cover foil 12 (13) is closer to the outer lead wire 9 (10) than the edge of the second end of the electrode bar 5*a* (6*a*) is, then (ii) bending the extended end of the sleeve-like cover foil 12 (13) inward to have the bent end latch onto the edge of the second end of the electrode bar 5*a* (6*a*). This method prevents the aforementioned sliding in a more reliable manner, especially when the cover foil 12 (13) is loosely wrapped around (or freely fit to) the second end of the electrode bar 5*a* (6*a*) due to the dimensional tolerance of the electrode bar 5*a* (6*a*) and the cover foil 12 (13). Needless to say, this method also suppresses formation of cracks originating from the vicinity of the second end of the electrode bar 5*a* (6*a*).

Another method is to insert a portion of the cover foil 12 (13) between the second end of the electrode bar 5*a* (6*a*) and the surface of the metallic foil 7 (8). This method may be used in combination with the above-described methods. This method can prevent the cover foil 12 (13) from sliding off its predetermined position on the electrode bar 5*a* (6*a*), more reliably and easily.

(3) Structure of Cover Foils

Electrodes other than the electrodes 5 and 6 explained in Embodiment 1 may be arranged in the arc tube 1 of the high-pressure mercury lamp pertaining to Embodiment 1. In such a case, it is preferable to use the alternative electrodes which will be described below. Since the structure of the alternative electrodes is different from that of the above-described electrodes 5 and 6, the following description focuses on features of the alternative electrodes that are different from those of the above-described electrodes 5 and 6.

Figure 11:
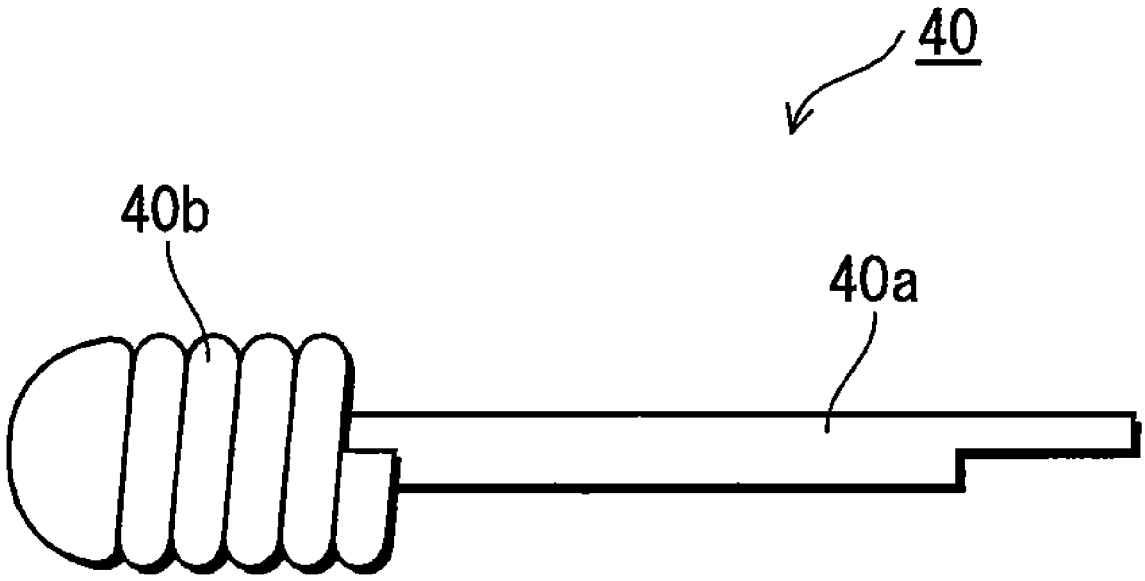
FIG. 11 is a front view exemplarily showing a variation of the electrode arranged in the arc tube constituting the high-pressure mercury lamp of the present invention.

As exemplarily shown in FIG. 11, electrodes 40 each include an electrode bar 40*a* that has a substantially cylindrical shape. However, the second end of the electrode bar 40*a*, which is joined to the surface of the metallic foil 7 (8), is cut in half. A cross section of this second end of the electrode bar 40*a* taken perpendicular to the longitudinal direction thereof has a substantially semicircular shape. Each electrode 40 also includes an electrode coil 40*b*.

When the sealing portion 3 (4) is formed with the electrode bar 5*a* (6*a*) that is not cut in half at the second end thereof and is therefore substantially cylindrical in shape, the second end of the electrode bar 5*a* (6*a*) would not be positioned on the central axis of the sealing portion 3 (4) in the longitudinal direction thereof, because the metallic foil 7 (8) is normally positioned on said central axis. However, during the sealing process, a portion of the electrode bar 5*a* (6*a*) to be embedded in the sealing portion 3 (4) tries to be positioned on said central axis. As a result, there is a possibility that the electrode bar 5*a* (6*a*) may be sealed in the sealing portion 3 (4) with the central axis of the electrode bar 5*a* (6*a*) in the longitudinal direction thereof tilted with respect to the central axis of the sealing portion 3 (4) in the longitudinal direction thereof. If the electrode bar 5*a* (6*a*) is thus tilted, the actual distance between the electrodes 5 and 6 will be different from a desired distance Ld. This lowers the luminance of the lamp, which ends up in the lamp having poor characteristics.

In contrast, by using the electrode bar 40*a* whose second end (which is joined to the metallic foil 7 or 8) is cut in half as shown in FIG. 11, the central axis of the electrode bar 40*a* in the longitudinal direction thereof is substantially in line with the central axis of the sealing portion 3 (4) in the longitudinal direction thereof. This way, the electrodes 40 are distant from each other by the desired distance Ld. Characteristics of the lamp are therefore not deteriorated.

(4) Cut-Out Section

According to Embodiment 1, the cut-out section 12*a* has a square shape when viewed perpendicular to the axis of the electrode bar 5*a* (see FIG. 3A). However, the cut-out section 12*a* may have other shapes, e.g., a semicircular shape, a semielliptical shape, and a polygonal shape such as a triangular shape.

According to Embodiment 1, the cover foil 12 (13) does not cover a back side of the joining (welding) area where the second end of the electrode bar 5*a* (6*a*) is joined to the metallic foil 7 (8) (provided that the electrode bar 5*a* (6*a*) is joined to a surface of the metallic foil 7 (8), said back side is on another surface of the metallic foil 7 (8)). However, the cover foil 12 (13) may cover said back side of the joining area.

Figure 12A:
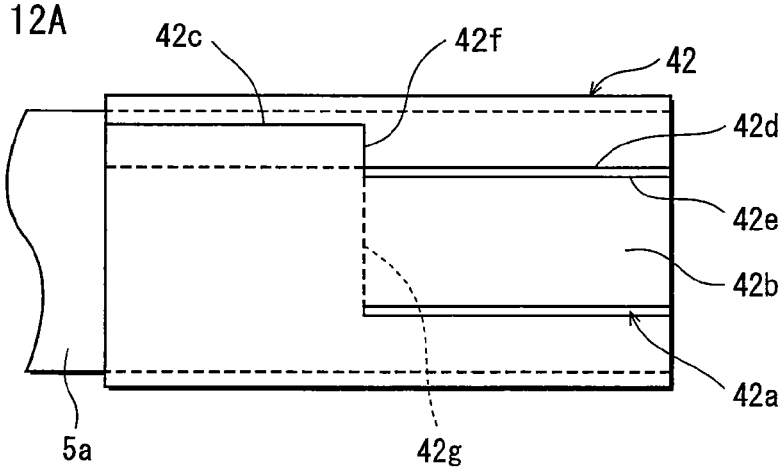
Figure 12B:
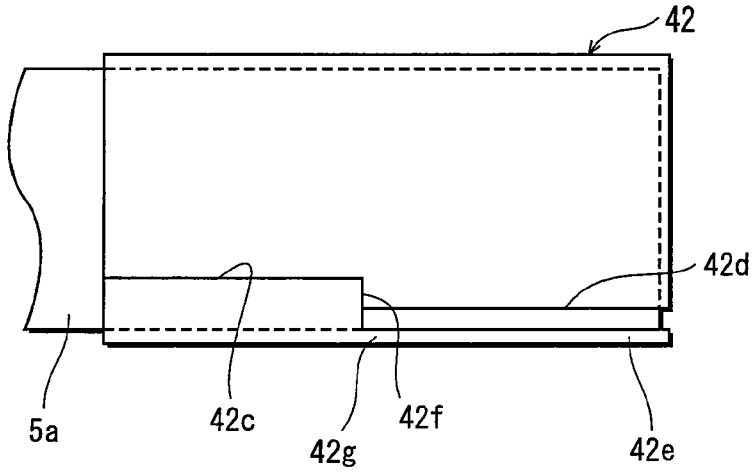
Figure 12C:
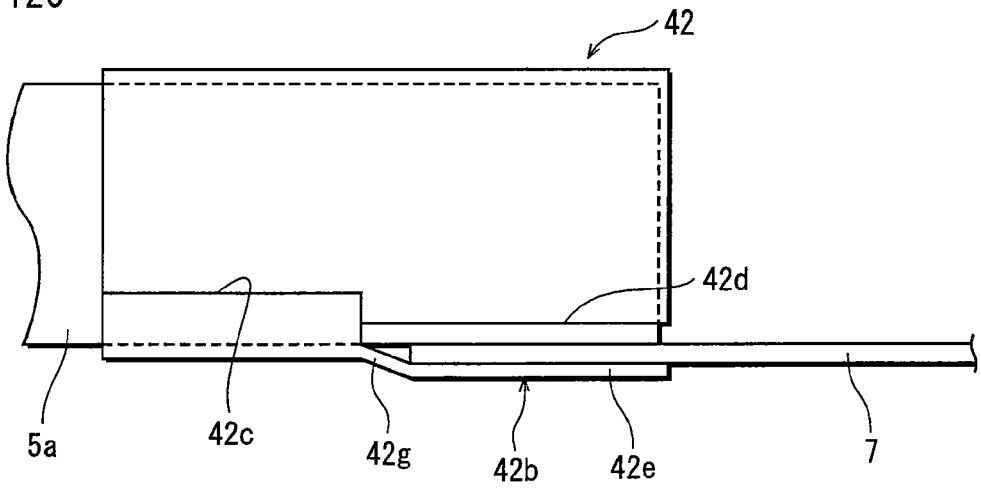

FIGS. 12A through 12C exemplarily show a different variation of a cover foil. FIG. 12A shows a cover foil 42 wrapped around the second end of the electrode bar 5*a* as viewed from an angle where the cut-out section is visible. FIG. 12B shows the cover foil 42 wrapped around the second end of the electrode bar 5*a* as viewed from a different angle.

FIG. 12C shows the cover foil 42 wrapped around the second end of the electrode bar 5*a* such that the cut-out section is positioned over the joining area where the electrode bar 5*a* is joined to the metallic foil 7.

The cover foil 42 is formed by first removing one corner from a sheet of foil (hereinafter, "foil sheet"), and then rolling the foil sheet into a sleeve-like shape. Referring to FIG. 12, an edge 42*d* is an edge of the foil sheet that is perpendicular to the rolling direction in which the foil sheet is rolled into a sleeve-like shape. Said one corner of the foil sheet has not been removed along any part of the edge 42*d*. Meanwhile, an edge 42*c* is another edge of the foil sheet that is perpendicular to the rolling direction. A part of the edge 42*c* has been cut off with the removal of said one corner.

The cover foil 42 of the present variation is formed in a similar manner as the cover foil 12 (13) of Embodiment 1. However, the area of the removed corner of the cover foil 42 is smaller than the area of the removed square corner of the cover foil 12 (13). Furthermore, provided in the unrolled foil sheet is a slit 42*a* that is (i) in parallel with the edges 42*c* and 42*d*, (ii) positioned between the edges 42*c* and 42*d*, and (ii) closer to the edge 42*c* than to the edge 42*d*. This slit 42*a* constitutes a part of the cut-out section of the cover foil 42.

Hence, as shown in FIG. 12A, once the above-described foil sheet is rolled into a sleeve-like shape (i.e., the sleeve-like cover foil 42), it has two slits into which the metallic foil 7 will be inserted. To be more specific, these two slits include (i) a slit enclosed by the edges 42*d*, 42*f* and 42*e* of the unrolled foil sheet and (ii) the aforementioned slit 42*a* provided in advance in the unrolled foil sheet. The sleeve-like cover foil 42 has a cover portion 42*b* enclosed by the two slits and a virtual line 42*g* that connects between ends of the two slits that are closer to the electrode coil 5*b* than the other ends thereof (the virtual line 42*g* is depicted as a dotted line in FIG. 12A). The cover portion 42*b* is bent outward at the virtual line 42*g*.

As shown in FIG. 12C, the cover foil 42 is wrapped around the second end of the electrode bar 5*a* joined to the metallic foil 7, with the metallic foil 7 inserted into the two slits. The cover portion 42*b* covers the back side of the joining area (the other surface of the metallic foil 7) where the second end of the electrode bar 5*a* is joined to the metallic foil 7. This prevents formation of cracks originating from the joining area.

(5) Manufacturing Method

According to Embodiment 1, the cover foil 12 (13) is formed by rolling a sheet of foil once. Alternatively, a cover foil may be formed by, for example, rolling a sheet of foil multiple times, or rolling a sheet of foil spirally. Alternatively, a cover foil may also be formed by rolling a plurality of sheets of foil multiple times. In these cases, a cut-out section may be formed in advance by removing a portion of each foil sheet before each foil sheet is rolled. Alternatively, a cut-out section may be formed by removing a portion of each foil sheet after each foil sheet is rolled into a sleeve-like shape.

Furthermore, a portion of each foil sheet to be removed to form the cut-out section is not limited to being one corner of each foil sheet. Such a portion to be removed may be located in the middle of each foil sheet, between the edges that are perpendicular to the rolling direction.

As described above, a sleeve-like cover foil is formed by rolling a sheet of foil. However, instead of this, a seamless sleeve-like cover foil may be used, which is formed by cutting a rod-shaped metal or the like into a sleeve-like shape. Alternatively, a sleeve-like cover foil may be formed by rolling a sleeve-like thick pipe.

When forming a sleeve-like cover foil by rolling a sheet of foil, the sheet may be rolled to have an inner diameter that is smaller than an outer diameter of the electrode bar, so that the rolled sheet has a springback effect. When such a cover foil is wrapped around the electrode bar, the adherence between the cover foil and the electrode bar is enhanced due to the springback. This prevents the cover foil from sliding off the electrode bar.

Use of the following exemplary technique can also prevent the cover foil from sliding off the electrode bar.

An area where the cover foil covers the second end of the electrode bar may be partially pressed from outside to form (i) a concave in the second end of the electrode bar and (ii) a convex in the cover foil, which is fit inside said concave. This way the convex in the cover foil latches to the concave in the second end of the electrode bar, thus preventing the cover foil from sliding off the electrode bar.

In a case where the second end of the electrode bar is spot-welded to the metallic foil, a concave is inevitably formed in the second end of the electrode bar, as a vestige of the spot-welding. Here, by mechanically pressing, from outside, a portion of the cover foil that is positioned over this concave, a pair of concave and convex similar to the above-mentioned concave and convex is formed. Such a pair of concave and convex can prevent the cover foil from sliding off the electrode bar. Said portion of the cover foil may be mechanically pressed from outside by applying laser light to a spot thereof. This forms a convex in the cover foil.

INDUSTRIAL APPLICABILITY

As the high-pressure discharge lamp of the present invention can effectively suppress damage to the sealing portions, it can be realized in the form of a high-pressure mercury lamp used as a light source for a projection type image display apparatus. The high-pressure discharge lamp of the present invention can also be realized in the form of a metal halide lamp and the like, and be used as, for example, a metal halide lamp for a headlamp attached to a car.

The invention claimed is:

1. A high-pressure discharge lamp comprising:

an arc tube, which is a glass enveloping vessel with a pair of electrodes arranged therein, wherein the arc tube includes:

a light emitting portion in which (i) one or more materials are enclosed and (ii) a discharge space is formed; and a pair of sealing portions provided at respective ends of the light emitting portion, each electrode includes an electrode bar whose one end is joined to a surface of a corresponding one of metallic foils, the one end of each electrode bar is partially wrapped around by a corresponding one of sleeve-like metallic cover foils, each cover foil having a cut-out section that is positioned over a joining area where the one end of each electrode bar is joined to the surface of the corresponding metallic foil, the cut-out section in each cover foil is formed by an opening in the cover foil at least from a circumferential edge of the cover foil above the corresponding metallic foil and extending through the length of the joining area, and each cover foil and each metallic foil are in a corresponding one of the sealing portions, with the one end of each electrode bar partially wrapped around by the corresponding cover foil.

2. The high-pressure discharge lamp of claim 1, wherein neither electrode bar is fixed to the corresponding cover foil.

3. The high-pressure discharge lamp of claim 1, wherein one end of each cover foil that is closer to the corresponding metallic foil than another end thereof has been bent, so that the bent end of each cover foil latches onto an edge of the one end of the corresponding electrode bar.

4. The high-pressure discharge lamp of claim 1, wherein a portion of each cover foil has been inserted between the one end of the corresponding electrode bar and the surface of the corresponding metallic foil.

5. The high-pressure discharge lamp of claim 1, wherein each cover foil is made of either (i) one of (a) molybdenum, (b) niobium, (c) rhenium, (d) tantalum and (e) tungsten, or (ii) an alloy whose major constituent is one of (a) through (e).

6. The high-pressure discharge lamp of claim 1, wherein each cover foil includes a cover portion that covers the joining area from another surface of the corresponding metallic foil.

7. The high-pressure discharge lamp of claim 1, wherein each electrode bar is substantially cylindrical in shape, except for the one end thereof, and a cross section of the one end of each electrode bar taken perpendicular to a longitudinal direction thereof has a substantially semicircular shape.

8. A lamp unit comprising:

the high-pressure discharge lamp of claim 1; and a reflector having a concave reflective surface, wherein the high-pressure discharge lamp is built in the reflector so that light emitted from the high-pressure discharge lamp is reflected by the reflective surface.

9. A projection type image display apparatus comprising:

the lamp unit of claim 8;

an optical unit operable to form an optical image by modulating light produced from the lamp unit; and a projection device operable to magnify the optical image and project the magnified optical image.

10. A high-pressure discharge lamp comprising:

an arc tube, which is a glass enveloping vessel with a pair of electrodes arranged therein, wherein the arc tube includes:

a light emitting portion in which (i) one or more materials are enclosed and (ii) a discharge space is formed; and a pair of sealing portions provided at respective ends of the light emitting portion, each electrode includes an electrode bar whose one end is joined to a surface of a corresponding one of metallic foils, the one end of each electrode bar is partially wrapped around by a corresponding one of sleeve-like metallic cover foils, each cover foil having a cut-out section that is positioned over a joining area where the one end of each electrode bar is joined to the surface of the corresponding metallic foil, and each cover foil and each metallic foil are in a corresponding one of the sealing portions, with the one end of each electrode bar partially wrapped around by the corresponding cover foil, wherein on one end of each cover foil that is closer to the corresponding metallic foil than another end thereof has been bent, so that the bent end of each cover foil latches onto an edge of the one end of the corresponding electrode bar.

* * * * *